US009733055B2

(12) United States Patent
Radojevic et al.

(10) Patent No.: US 9,733,055 B2
(45) Date of Patent: Aug. 15, 2017

(54) DYNAMIC IGNITION AND IGNITION DELAY MULTI-MODE FUSE SYSTEM

(75) Inventors: Milan Radojevic, Eskilstuna (SE); Anders Nylén, Eskilstuna (SE); Olov Thor, Strängnäs (SE)

(73) Assignee: SAAB AB, Linköping (SE)

( * ) Notice: Subject to any disclaimer, the term of this patent is extended or adjusted under 35 U.S.C. 154(b) by 206 days.

(21) Appl. No.: 14/345,617

(22) PCT Filed: Sep. 16, 2011

(86) PCT No.: PCT/SE2011/000161

§ 371 (c)(1),
(2), (4) Date: Oct. 9, 2014

(87) PCT Pub. No.: WO2014/081350

PCT Pub. Date: May 30, 2014

(65) Prior Publication Data

US 2015/0040787 A1 Feb. 12, 2015

(51) Int. Cl.
*F42C 11/00* (2006.01)
*F42C 11/02* (2006.01)
(Continued)

(52) U.S. Cl.
CPC ..... *F42C 11/00* (2013.01); *F42C 1/10* (2013.01); *F42C 1/12* (2013.01); *F42C 9/14* (2013.01);
(Continued)

(58) Field of Classification Search
CPC ..... F42C 1/00; F42C 1/12; F42C 1/14; F42C 9/14; F42C 11/00; F42C 11/02; F42C 11/06; F42C 11/065
(Continued)

(56) References Cited

U.S. PATENT DOCUMENTS 4,799,427 A 1/1989 Held et al.
5,497,704 A 3/1996 Kurschner et al.
(Continued)

FOREIGN PATENT DOCUMENTS

WO WO-03/051794 A2 6/2003
WO WO-2010053407 A1 5/2010

OTHER PUBLICATIONS

PCT/ISA/210—International Search Report—May 8, 2012 (Issued in PCT/SE2011/000161).
(Continued)

*Primary Examiner* — James S Bergin
(74) *Attorney, Agent, or Firm* — Venable LLP; Jeffri A. Kaminski

(57) ABSTRACT

A multi-mode fuse system for use in a warhead for combating a target. At least one target sensor is electrically connected to a signal processing block and an I/O-block. The I/O-block is configured to be set by the operator of the warhead. The target sensor is adapted to generate an electrical output in response to the rate of deceleration of the warhead. The fuse system is adapted to discriminate the hardness of the target based upon the electrical output of the target sensor and to select the mode of operation depending upon the target discrimination. The fuse system is adapted to discriminate at least one type of target depending upon the electrical output of the target sensors. The fuse system selects one of at least three modes of operation of the warhead. Also a method for classifying the target hardness and selection of the operational mode of a warhead.

10 Claims, 3 Drawing Sheets

(51) Int. Cl.

| | |
|---|---|
| ***F42C 1/12*** | (2006.01) |
| ***F42C 9/14*** | (2006.01) |
| ***F42C 11/06*** | (2006.01) |
| ***F42C 1/10*** | (2006.01) |
| ***F42C 19/07*** | (2006.01) |

(52) U.S. Cl.
CPC ..... *F42C 11/02* (2013.01); *F42C 11/065* (2013.01); *F42C 19/07* (2013.01)

(58) Field of Classification Search
USPC ..... 102/206, 210, 216, 265, 266, 270, 271, 102/272
See application file for complete search history.

(56) References Cited

U.S. PATENT DOCUMENTS

| | | | | |
|---|---|---|---|---|
| 5,872,324 | A | 2/1999 | Watson, Jr et al. | |
| 8,091,478 | B1 * | 1/2012 | Khuc | F42C 9/147 102/275.3 |
| 2012/0012020 | A1 * | 1/2012 | Remahl | F42C 11/02 102/210 |

OTHER PUBLICATIONS

PCT/ISA/237—Written Opinion of the International Searching Authority—May 8, 2012 (Issued in PCT/SE2011/000161).

* cited by examiner

DYNAMIC IGNITION AND IGNITION DELAY MULTI-MODE FUSE SYSTEM

TECHNICAL FIELD

The present invention relates to a multi mode fuze system for use in a warhead for combating a target. This invention also relates to a method for classification of target hardness and mode selection for a fuze.

BACKGROUND ART

Different solutions for fuzes and ignitors for munitions, in particular warheads, are previously well known A fuze assembly contains all mechanical, chemical and electrical components to initiate a detonator. According to the state of the art different fuze and igniter arrangements are known for dynamically selecting mode of operation of the warhead or munition. A common practice is to select different modes of operation for different targets.

It is known that a piezoelectric crystal could be used to initiate the ignition of the warhead when the warhead hits a target. In the described known solutions no target identification and/or classification are disclosed.

It is also known that measurement of the deceleration forces of the warhead, when the warhead strikes the target, could be used to initiate the warhead. Such warheads utilize an accelerometer as sensor for measuring the deceleration forces. The information given by the accelerometer is the deceleration force that is proportional to the hardness of the target.

Also known are ignition systems based on relative velocity sensors utilizing at least two switches spaced apart by predetermined distance along the nose of the projectile fuze. The switches are sequentially activated by contact with the target and thus providing electrical signals from which the relative velocity of the projectile could be calculated.

It is also known that sensors or impact fuzes are used for sensing the hardness of a target and, based on the sensed hardness, triggering the ignition of the warhead inside or outside of a target. The impact fuze includes a first sensor for sensing soft targets and a second sensor for sensing hard targets.

Utilizing piezoelectric crystals as an impact sensor in the warhead is previously known. An invention utilizing a piezoelectric sensor as an impact sensor is described in patent document WO 03/051794 A2. The patent document describes a multi-mode haze with at least one sensor that generates an electrical output dependent upon the rate of deceleration when the munition impacts a target. The described multi-mode haze comprises a logic circuit electrical coupled to at least one sensor that discriminates between a soft and a hard target and operates in two operational modes.

A disadvantage with the solution described in WO 03/051794 A2 for target identification is the dependence upon an external power sources for driving the fuze and electronics. The external power source, such as a battery, is expensive and bulky and the performance of the power source is commonly degraded over time.

A further problem with the solution described in WO 03/051794 A2 is the limitation to two operational modes which restricts the use of the warhead.

SUMMARY OF THE INVENTION

Accordingly, it is an object of the invention to provide a reliable multi-mode fuze, which operates in more than two operational modes independent upon external power sources capable of detonating a warhead instantaneously or after a time delay based upon information gathered during the deceleration of the warhead or based upon pre-programmed information.

Another object of the new invention is to eliminate drawbacks associated with the solutions known in the prior art.

Another object is to provide an apparatus and method for distinguishing different targets, provide electrical energy, and classify the target and to select the proper ignition mode and/or time delay.

Other problems solved by the invention are described in the detailed description, The new invention describes that the piezoelectric sensor traditionally used for initiating the warhead also could be used to extract target information and to provide electrical energy. Extraction of target information results in an improved method for target classification, mode decision, time delay and control of ignition of a warhead and an improved ignition system. Extraction of electrical energy from the piezoelectric sensor provides the electrical energy needed for the electronic circuit to process the information from the piezoelectric sensor and electrical energy to ignite and initiate the detonation of the warhead.

The new invention discloses a multi-mode fuze system for use in a warhead for combating a target, said multi-mode fuze system comprise at least one target sensor electrically connected to a signal processing, block and an I/O-block, where said I/O-block is possible to set by the operator of the warhead, where said target sensor is adapted to generate an electrical output in response to the rate of deceleration of the warhead and where said multi-mode fuze system is adapted to discriminate the hardness of the target based upon the electrical output of said target sensor and to select the mode of operation depending upon the said target discrimination, wherein the multi-mode fuze system is adapted to discriminate at least one type of target depending upon said target sensors electrical output and that the multi-mode fuze system selects one of at least three modes of operation of the warhead.

Furthermore the improved multi-mode fore system according to the invention discloses;

that all electrical energy needed for operating the multi-mode fuze system is provided by the target sensor.

that the target sensor is a piezoelectric sensor, that the discrimination of the hardness of the target is decided upon the said target sensors electrical output signals rise time characteristics.

that the discrimination of the hardness of the target is decided upon integration of the said target sensors electrical output signal.

that the three modes of operation are;

a first mode of warhead initiation on the surface of the target, a second mode of warhead initiation in the bulk of the target, a third mode of warhead initiation behind the bulk of the target.

that the first mode of operation is limited to be utilized within a specified time frame of 5 ms after impact of the warhead in the target.

The invention also discloses a method for classifying the target hardness and selection of the operational mode of a warhead for a warhead combating a target, said target hardness is determined from an electrical output signal generated by a target sensor in response to the rate of deceleration and that the said operational mode is settable by an operator where;

(a) the rise time of the electrical output signal is measured,
(b) a first mode of operation of the warhead is selected if the rise time is below a rise time threshold,
(c) a second mode of operation of the warhead is selected if the rise time is above a rise time threshold and the warhead is set for the second mode of operation,
(d) a third mode of operation of the warhead is selected if the rise time is above a rise time threshold and the warhead is set for the third mode of operation.

Furthermore the improved method for classifying the target hardness and selection of the operational mode of a warhead according to the invention discloses;
that the first mode of operation is limited to be utilized within a specified time frame of 5 ms after impact of the warhead in the target.

BRIEF DESCRIPTION OF THE DRAWINGS

The invention will be described in greater detail below by way of illustration of embodiments and with reference to the attached drawings, in which.

DETAILED DESCRIPTION

Figure 1:
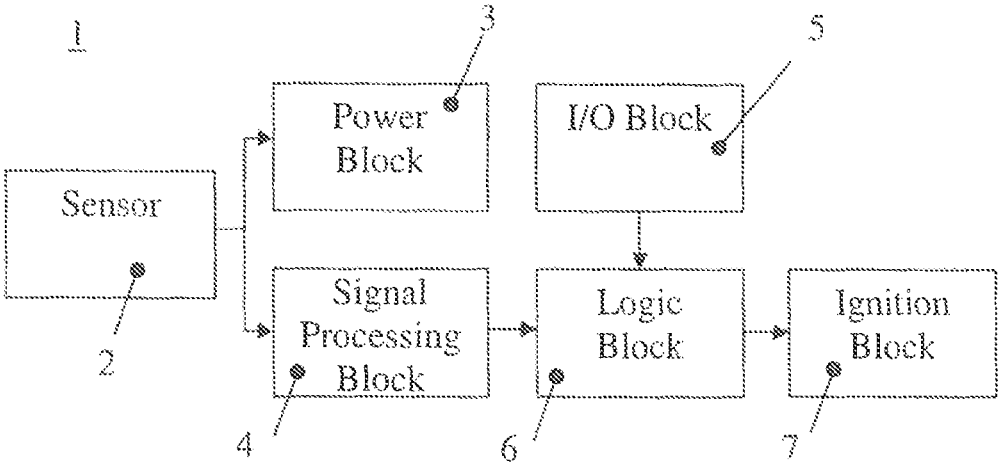
FIG. 1 shows a schematic view of the ignition circuit, in accordance with the present invention.

A schematic diagram of the ignition circuit 1 for the multi-mode fuze is shown in FIG. 1. A target sensor 2 will upon impact with the target provide an electrical signal and electrical energy. The target sensor 2 could be a piezoelectric element or piezoelectric crystal but also other types of sensors providing electrical charge and electrical energy upon pressure from impact or from the deceleration. The electrical energy is stored in and managed by the power block 3 and the electrical energy is distributed by the power block 3 within the ignition circuit I to supply the electrical circuits with electrical energy. The electrical signal is also electrically connected to a signal processing block 4 containing a microprocessor or other device or system for receiving and evaluating the electrical signal. From the signal processing block 4 an electrical signal is electrical connected to a logic block 6. In the logic block 6 one of the at least three different modes are selected depending upon information from the signal processing block 4 and/or front the I/O-block 5. The three different modes are; a first mode, the direct mode, for detonation of the warhead at the surface of the target or when parts of the warhead either is deformed by or penetrated in the targets surface, a second mode for detonation of the warhead inside the targets first surface or wall and a third mode for detonation of the warhead beyond the surface of the target, within or beyond the target. The I/O-block 5 provides an electrical signal to the logic block 6 with information of the, by the operator or some other way, decided operational mode. Information to the I/O-block 5 is programmed or in another way provided to the I/O-block 5 by the operator or the operator system of the warhead. The logic block 6 decides the operational mode and/or time delay before initiation in the ignition block 7. The electrical energy for initiation of detonation of the warhead is provided by the power block 3. The power block 3 has electrical energy charged in a capacitor or in another way stored in the power block 3. Preferably all electrical energy stored in the power block 3 is or was generated by the sensor 2 upon impact of the warhead with the target. If the electrical energy generated by the sensor 2 is insufficient an additional power source such as a battery or charged capacitor, in the figure not shown, could provide additional electrical power.

Figure 2:
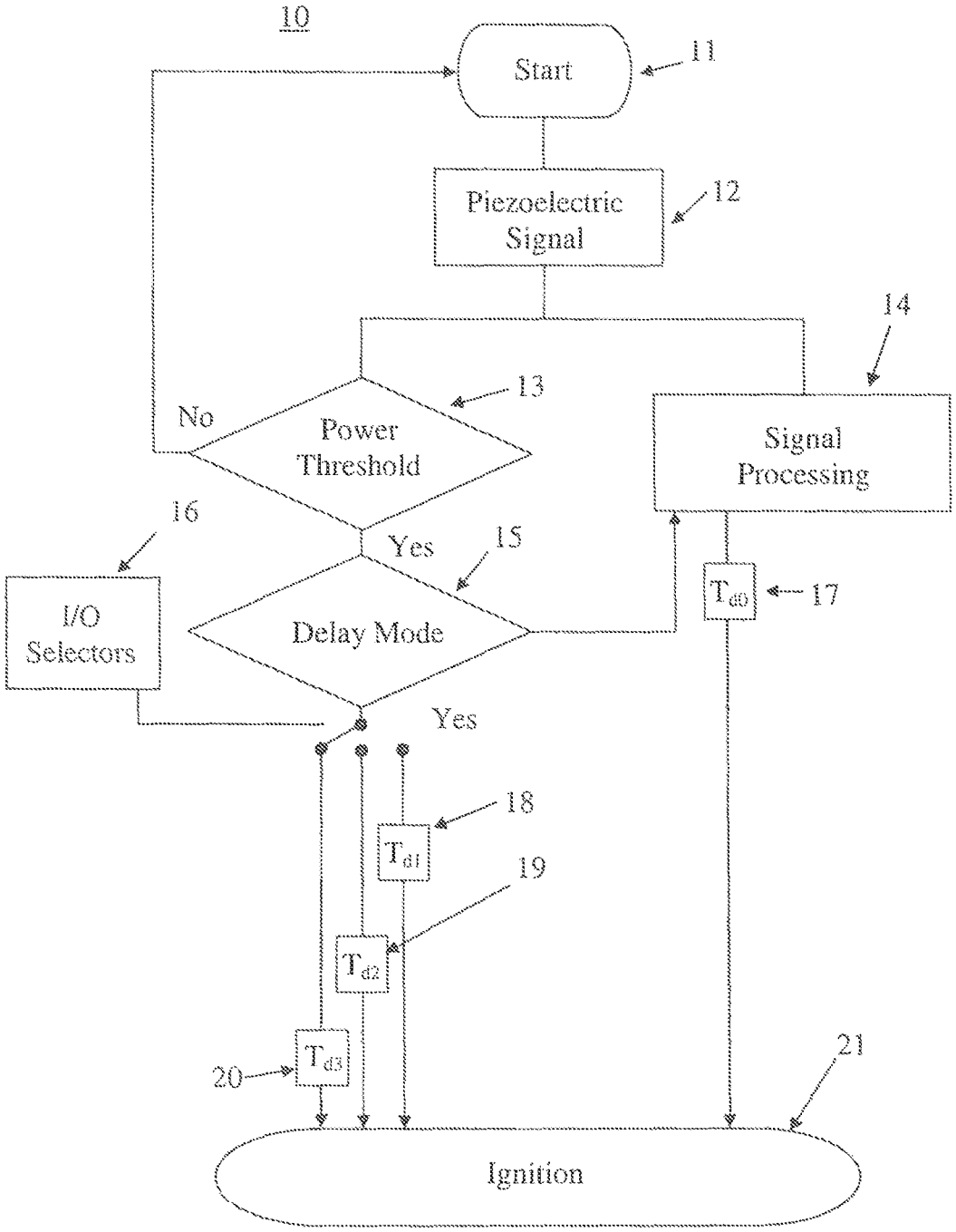
FIG. 2 shows a decision tree for mode selection in accordance with the present invention.

A flow chart or decision tree 10 for mode selection is illustrated in FIG. 2. In the illustrated version, shown in FIG. 2, there are in total four modes for initiating the detonation of the warhead, the four modes are three time modes and one direct mode. In a preferred embodiment of the invention only three modes are utilized. The start 11 function is the stand by mode before the ignition circuit 1 is energized. When the piezoelectric signal 12 is activated by the physical deformation of the warhead the signal provides both electrical energy to drive the ignition circuit 1 and signal information for the evaluation, decision and selection of operational mode. The operational mode is decided upon information from the signal processing 14 function.

The signal processing 14 function starts directly when the electronic circuit is energized. It is thus important to have an electronic circuit that have low start up delay and could be driven by low amount of electrical energy. The delay modes 15 function could be selected when the power threshold 13 function is above a certain level determined from extensive experimental tests. Depending upon the targets characteristics different modes 17, 18, 19 and 20 could be selected. The warhead have at least three operational modes 17, 18 and 19 wherein one operational mode is a direct mode, with or without a time delay, and two operational modes are time modes with time delay. The first operational mode, the direct mode, is for detonation of the warhead at the surface of the target or when parts of the warhead either is deformed by or penetrated in the targets surface. in this operational mode the time delay $T_{d0}$ 17 is short, zero or close to zero. The first operational mode could be limited to be utilized within a specified time frame of 5 ms, or less than 5 ms, after impact of the warhead in the target. If the specified time frame. has passed the first operational mode could not be selected. A second operational mode is for detonation of the warhead inside the targets first surface or wall or in the bulk of the target. The time delay for this operational mode is $T_{d1}$ 18. A third operational mode is for detonation beyond the surface of the target, within or beyond the target or behind the bulk of the target. The time delay for this operational mode is $T_{d2}$ 19. The operator or the operator system of the warhead or weapon system decides, before firing the warhead, the intended mode of operation from an I/O selector 16. The decision made by the operator is primarily if a strike is intended for the targets first surface or beyond the targets first surface. The operator selects with the I/O selector 16 if the second or third operational mode is preferred and the first operational mode is automatically selected by the fuze overriding the second or third mode. A fourth operational mode, $T_{d3}$ 20, or even. more operational modes are possible for other embodiments not further described. The relation in time between the different time delays are $T_{d0}<T_{d1}<<T_{d2}$.

In as preferred embodiment the second operational mode is selected in the case the warhead is intended to destruct an obstruction such as a wall and the detonation is close to or inside the wall structure or the bulk of the target and the third operational mode is selected in the case the warheads detonation is intended to be inside, a physical structure. such as a house behind a wall or in the bulk of the target. In the preferred embodiment the first operational mode is automatically and/or autonomously selected by the warhead to automatically go to detonation at the targets surface. Alternate embodiments could include that all operational modes are manually selected by the operator of the munition or warhead launcher before firing the warhead. Another alternate embodiment could include that all operational modes are automatically selected by logic contained in the warhead depending upon the characteristics of the piezoelectric signal 12 upon impact of the warhead with the target. Another alternate embodiment could include that a combination of manual, by the user or operator decided, and automatic, by the warhead decided, selection of operational modes.

The sensor signal is evaluated depending upon the characteristics of the signal. The sensor signals rise time is proportional to the hardness of the target. By measuring the rise time of the sensor signal, such as the piezoelectric signal 12, the hardness of the target could be estimated. The sensor signal, such as the piezoelectric signal 12, could also be evaluated by integrating the piezoelectric signal 12 or by the action integral of the piezoelectric signal 12 or in some other way where the sensor signals relative level is evaluated over time.

Due to the hardness of the target the signal or the rise time of the signal from the sensor 2 could also appears earlier in a hard material compared to softer materials due to the unwillingness of the hard target material to move. By having an operational window in time for when the warhead detects a hard material the warhead could avoid detection error and/or misinterpretation of the target.

Figure 3:
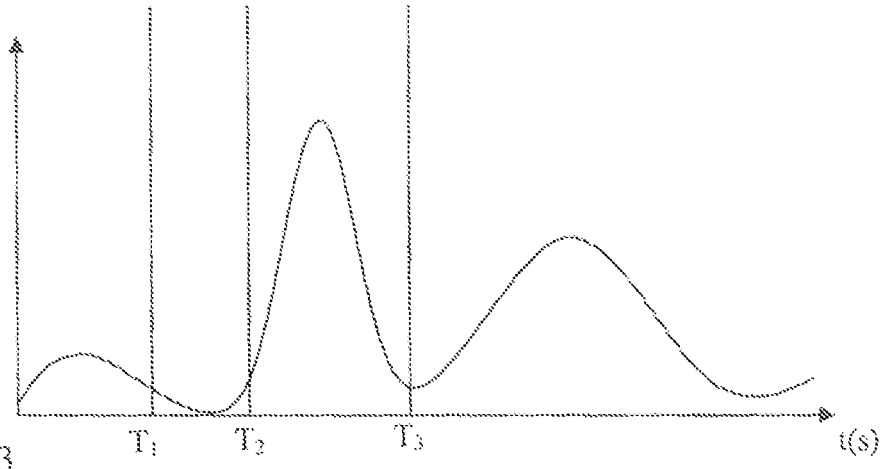
FIG. 3 shows an example of an output signal from the piezoelectric crystal in accordance with the present invention.

An example of a fictitious hut descriptive output signal from a piezoelectric sensor is shown in FIG. 3. Over time, during compression of the piezoelectric crystal, an output voltage is generated by the crystal. Before a certain time period $t_1$ the ignition circuit 1 is not powered and the circuit is in this instance charged with electrical energy generated by the sensor 12. After the time period $t_1$ the ignition circuit 1 is powered and the signal processing is starting. During a defined window, started at time $t_2$ and ended on time $t_3$, the ignition circuit 1 is sensitive for the direct mode. After the end of the defined widow, $t_3$, the warhead is in normal operational order where the second, third or other operational mode could be selected and/or executed.

Alternative Embodiments

The invention is not limited to the shown embodiments. The invention could be varied regarding to the number of elements, size, material, and form factor within the scope of the patent claims.

It is obvious that the presented new invention could be used for all kinds of munitions for all types of weapons including warheads, rockets, ammunition, shells, missiles, and grenades for rocket launchers, guns, cannons, artillery, and missiles.

The invention claimed is:

1. A multi-mode fuse system for use in a warhead for combating a target, said multi-mode fuse system comprising:

at least one target sensor electrically connected to a signal processing block and an I/O-block, wherein said I/O-block is configured to be set by an operator of the warhead, wherein said at least one target sensor is adapted to generate an electrical output signal in response to a rate of deceleration of the warhead, wherein said multi-mode fuse system is adapted to discriminate a hardness of the target based upon the electrical output signal of said at least one target sensor and to select a mode of operation depending upon the target discrimination, wherein the multi-mode fuse system is adapted to discriminate at least one type of target depending upon the electrical output of the at least one target sensor, and wherein the multi-mode fuse system selects one of at least three modes of operation of the warhead.

2. The multi-mode fuse system according to claim 1, wherein all electrical energy needed for operating the multi-mode fuse system is provided by said at least one target sensor.

3. The multi-mode fuse system according to claim 2, wherein said at least one target sensor is a piezoelectric sensor.

4. The multi-mode fuse system according to claim 1, wherein the discrimination of the hardness of the target is decided upon rise time characteristics of the electrical output signal of said at least one target sensor.

5. The multi-mode fuse system according to claim 1, wherein the discrimination of the hardness of the target is decided upon integration of the electrical output signal of said at least one target sensor.

6. The multi-mode fuse system according to claim 1, wherein the at least three modes of operation comprise:

a first mode of warhead initiation on the surface of the target, a second mode of warhead initiation in the bulk of the target, and a third mode of warhead initiation behind the bulk of the target.

7. The multi-mode fuse system according to claim 6, wherein the first mode of operation is limited to be utilized within a specified time frame of 5 ms after impact of the warhead in the target.

8. A method for classifying a target hardness and selection of an operational mode of a warhead for a warhead combating a target, said target hardness is determined from an electrical output signal generated by at least one target sensor in response to the rate of deceleration and the operational mode is settable by an operator, the method comprising:

measuring a rise time of the electrical output signal, selecting a first mode of operation of the warhead if the rise time is below a rise time threshold, selecting a second mode of operation of the warhead if the rise time is above a rise time threshold and the warhead is set for the second mode of operation, and selecting a third mode of operation of the warhead if the rise time is above a rise time threshold and the warhead is set for the third mode of operation.

9. The method for classifying the target hardness and selection of the operational mode of a warhead according to claim 8, wherein the first mode of operation is limited to be utilized within a specified time frame of 5 ms after impact of the warhead in the target.

10. A multi-mode fuse system for use in a warhead for combating a target, said multi-mode fuse system comprising:

at least one target sensor adapted to generate an electrical output signal in response to a rate of deceleration of the warhead and to provide electrical charge and electrical energy upon pressure from impact or from deceleration;

a signal processing block electrically connected to the at least one target sensor and including a system for receiving and evaluating the electrical signal;

a logic block comprising information regarding a decided operational mode;

an I/O block configured to be set by an operator of the warhead, wherein the I/O block is adapted to provide an electrical signal to the logic block;

wherein said multi-mode fuse system is adapted to discriminate a hardness of the target based upon the electrical output signal of said at least one target sensor and to select a mode of operation depending upon the target discrimination, wherein the multi-mode fuse system is adapted to discriminate at least one type of target depending upon said electrical output signal of said at least one target sensor, and wherein the multi-mode fuse system selects one of at least three modes of operation of the warhead.

* * * * *